US008904938B2

(12) United States Patent
Sasaki et al.

(10) Patent No.: US 8,904,938 B2
(45) Date of Patent: Dec. 9, 2014

(54) BLASTING CARTRIDGE, BLASTING APPARATUS, AND BLASTING METHOD

(75) Inventors: Katsuya Sasaki, Osaka (JP); Hideaki Kitajima, Osaka (JP); Ryo Sakamoto, Osaka (JP); Takaaki Ohnishi, Osaka (JP)

(73) Assignee: Hitachi Zosen Corporation (JP)

( * ) Notice: Subject to any disclaimer, the term of this patent is extended or adjusted under 35 U.S.C. 154(b) by 0 days.

(21) Appl. No.: 13/498,514

(22) PCT Filed: Sep. 1, 2010

(86) PCT No.: PCT/JP2010/064892

§ 371 (c)(1), (2), (4) Date: Mar. 27, 2012

(87) PCT Pub. No.: WO2011/036983

PCT Pub. Date: Mar. 31, 2011

(65) Prior Publication Data

US 2012/0180684 A1 Jul. 19, 2012

(30) Foreign Application Priority Data

Sep. 28, 2009 (JP) ..... 2009-222082

(51) Int. Cl.

| | |
|---|---|
| ***F42B 3/00*** | (2006.01) |
| ***F42B 3/10*** | (2006.01) |
| ***F42C 19/12*** | (2006.01) |
| ***F42B 3/12*** | (2006.01) |
| ***E04G 23/08*** | (2006.01) |
| ***F42B 3/11*** | (2006.01) |
| ***F42D 3/04*** | (2006.01) |

(52) U.S. Cl.

CPC . *F42B 3/11* (2013.01); *F42B 3/124* (2013.01); *F42B 3/00* (2013.01); *F42B 3/128* (2013.01); *E04G 23/083* (2013.01); *F42D 3/04* (2013.01)

USPC ..... 102/322; 102/301; 102/202.7

(58) Field of Classification Search

CPC ..... F42D 1/045; F42D 1/04; F42D 1/05; E04G 23/083; F42B 3/00; F42B 3/10; F42B 3/11; F42B 3/12; F42B 3/124; F42B 3/128

USPC ..... 102/301, 302, 322, 332, 202.5, 202.7, 102/202.9, 202.11, 205, 312, 313, 202

See application file for complete search history.

(56) References Cited

U.S. PATENT DOCUMENTS 3,040,660 A 6/1962 Johnston
3,686,934 A * 8/1972 Farrand et al. ..... 86/1.1

(Continued)

FOREIGN PATENT DOCUMENTS

CN 1251165 A 4/2000
CN 1269735 A 10/2000

(Continued)

OTHER PUBLICATIONS

International Preliminary Report on Patentability issued in connection with corresponding PCT/JP2010/064892 and the English language translation.

*Primary Examiner* — James Bergin
(74) *Attorney, Agent, or Firm* — Ostrolenk Faber LLP

(57) ABSTRACT

A blasting cartridge includes a generally cylindrical blasting container, a blasting substance filled in the blasting container, a pair of leadwires contained in the blasting container, and a single thin metal wire connected to tip portions of the pair of leadwires. The leadwires and the thin metal wire are positioned within the blasting substance within the blasting container. The blasting substance is nitromethane, and the thin metal wire is formed of tungsten. With an electric discharge impact blasting apparatus, since the thin metal wire has a higher heating value than a copper wire because of its higher resistance and vaporizes at higher temperatures, it is possible to obtain a greater blasting force at lower voltages than with a blasting apparatus using a copper wire.

8 Claims, 6 Drawing Sheets

(56) References Cited

U.S. PATENT DOCUMENTS

| | | | | |
|---|---|---|---|---|
| 4,428,292 | A * | 1/1984 | Riggs | 102/202.7 |
| 4,976,200 | A * | 12/1990 | Benson et al. | 102/202.7 |
| 6,298,785 | B1 | 10/2001 | Maehata et al. | 102/301 |
| 6,318,268 | B1 * | 11/2001 | Maehata et al. | 102/202.7 |
| 6,389,973 | B1 * | 5/2002 | Arai et al. | 102/202.7 |
| 6,408,761 | B1 * | 6/2002 | Arai et al. | 102/302 |
| 7,150,409 | B2 * | 12/2006 | Gonnelli et al. | 239/1 |
| 2013/0263753 | A1 * | 10/2013 | Sasaki et al. | 102/322 |

FOREIGN PATENT DOCUMENTS

| | | |
|---|---|---|
| JP | 11-257899 | 9/1999 |
| JP | 3672443 | 4/2005 |
| JP | 2008-202106 | 9/2008 |
| JP | 2008-218040 | 9/2008 |

* cited by examiner

BLASTING CARTRIDGE, BLASTING APPARATUS, AND BLASTING METHOD

CROSS REFERENCE TO RELATED APPLICATIONS

The present application is a 35 U.S.C. §371 national phase conversion of PCT/JP2010/064892 filed Sep. 1, 2010 and claims priority of JP2009-222082 filed Sep. 28, 2009, both incorporated herein in their entirety.

TECHNICAL FIELD

The present invention relates to a blasting apparatus that blasts an object.

BACKGROUND ART

Conventionally, a method using an impact force caused by combustion of a blasting substance other than gunpowder has been known as a method for blasting an object such as a concrete structure or a rock. For example, the blasting apparatus disclosed in Japanese Patent No. 3672443 (Document 1) includes a thin metal wire formed of copper, a pair of electrodes whose tips are connected to each other with the thin metal wire, nitromethane serving as a blasting substance, and a blasting container that contains these constituent elements. When blasting an object with the blasting apparatus, the blasting container is inserted in a placement hole formed in the object, and combustion of nitromethane is caused by supplying charging energy to the thin metal wire in a short time. With the blasting apparatus, an expansive force of the thin metal wire when melting and vaporizing and the combustion force of nitromethane cause blasting of an object.

Incidentally, with the blasting apparatus disclosed in Document 1, a copper wire is used as the thin metal wire connected to the electrodes. However, in order to melt and vaporize such a thin metal wire, a voltage to be applied to the electrodes usually exceeds 3000 V, and a current of 5000 A or higher is necessary. Thus, high voltage and large current are required.

SUMMARY OF INVENTION

It is an object of the present invention to obtain a greater blasting force at lower voltages than a blasting apparatus including a thin metal wire of copper.

The present invention is intended for a blasting cartridge to be used in a blasting apparatus that blasts an object. The blasting cartridge includes a self-reactive blasting substance, a container that contains the blasting substance, a thin tungsten wire disposed within the blasting substance, and a pair of leadwires whose ends are connected to both ends of the thin tungsten wire and whose other ends are connected to a power supply device outside the container. This structure enables a greater blasting force to be obtained at lower voltages.

In a preferred embodiment of the present invention, the thin tungsten wire is formed of a single thin metal wire or two or three stranded thin metal wires. More preferably, the thin tungsten wire has a length greater than or equal to 10 mm and less than or equal to 120 mm and a cross-sectional area greater than or equal to 0.03 $mm^2$ and less than or equal to 0.13 $mm^2$. The blasting substance is preferably nitromethane.

The present invention is also intended for a blasting apparatus and a blasting method for blasting an object.

These and other objects, features, aspects and advantages of the present invention will become more apparent from the following detailed description of the present invention when taken in conjunction with the accompanying drawings.

DESCRIPTION OF EMBODIMENTS

Figure 1:
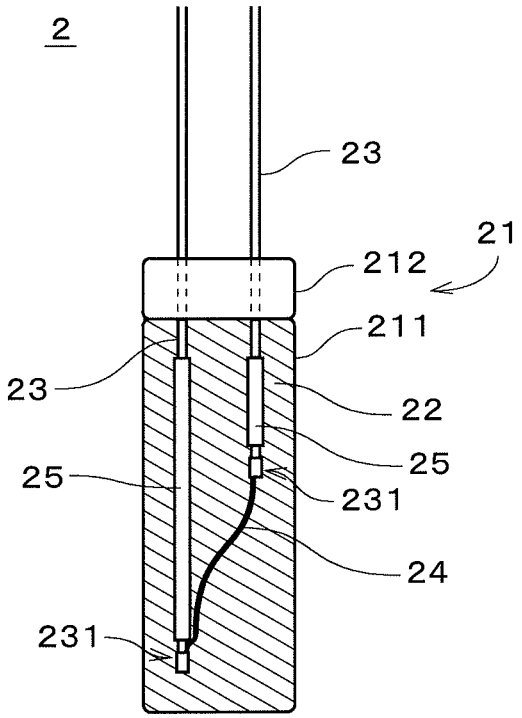
FIG. 1 shows a blasting cartridge.

FIG. 1 shows a blasting cartridge 2 according to an embodiment of the present invention. The blasting cartridge 2 (hereinafter simply referred to as the "cartridge 2") is used to blast an object such as a concrete structure, a reinforced concrete structure, a rock, or bedrock.

The cartridge 2 includes a generally cylindrical blasting container 21 formed of plastic or the like, a blasting substance 22 contained in the blasting container 21, a pair of leadwires 23 inserted in the blasting container 21, and a single thin metal wire 24 connected to tip portions 231 of the pair of leadwires 23. The leadwires 23 and the thin metal wire 24 are positioned within the blasting substance 22 within the blasting container 21, and the leadwires 23 are covered with insulating tubes 25. The blasting container 21 includes a container body 211 having an opening at the top, and a lid portion 212 that closes the opening of the container body 211 so as to seal the container body 211.

Figure 2:
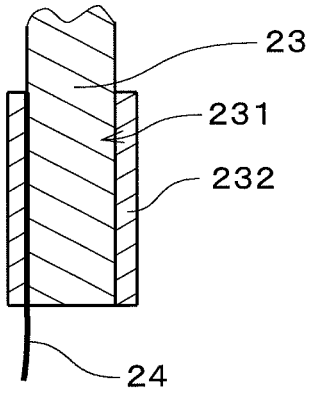
FIG. 2 is an enlarged view showing the vicinity of an electrode.

The leadwires 23 pass through the lid portion 212 of the blasting container 21 and are fixedly positioned by the lid portion 212 within the container body 211. FIG. 2 is a cross-sectional view of the tip portion 231 of a leadwire 23. At the tip portion 231, an end portion of the thin metal wire 24 is fixed to the leadwire 23 by crimping with a crimping sleeve 232 serving as a crimp contact.

The blasting substance 22 is a self-reactive substance other than gunpowder and is, for example, a substance that can burn in an anoxic or hypoxic environment. In the present embodiment, liquid nitromethane is used. The thin metal wire 24 is formed of tungsten and has a sufficiently smaller thickness than the leadwires 23. The thin metal wire 24 has a length of 30 mm and a diameter of 0.3 mm (i.e., a cross-sectional area of 0.07 $mm^2$).

When assembling the cartridge 2, firstly the lid portion 212 of the blasting container 21 is attached to the leadwires 23 in FIG. 1, and then the end portions of the thin metal wire 24 are each fixed by crimping between the tip portion 231 of the leadwire 23 and the crimping sleeve 232 shown in FIG. 2.

By filling the blasting substance 22 in the container body 211 shown in FIG. 1 and attaching the lid portion 212 to the container body 211, the leadwires 23 and the thin metal wire 24 are positioned within the blasting substance 22. The amount of the blasting substance 22 is 25 ml. Note that the amount of the blasting substance 22 is preferably greater than or equal to 2 ml (milliliter) in order to obtain a minimum blasting force, and is preferably less than or equal to 50 ml in order not to leave unreacted liquid.

Figure 3:
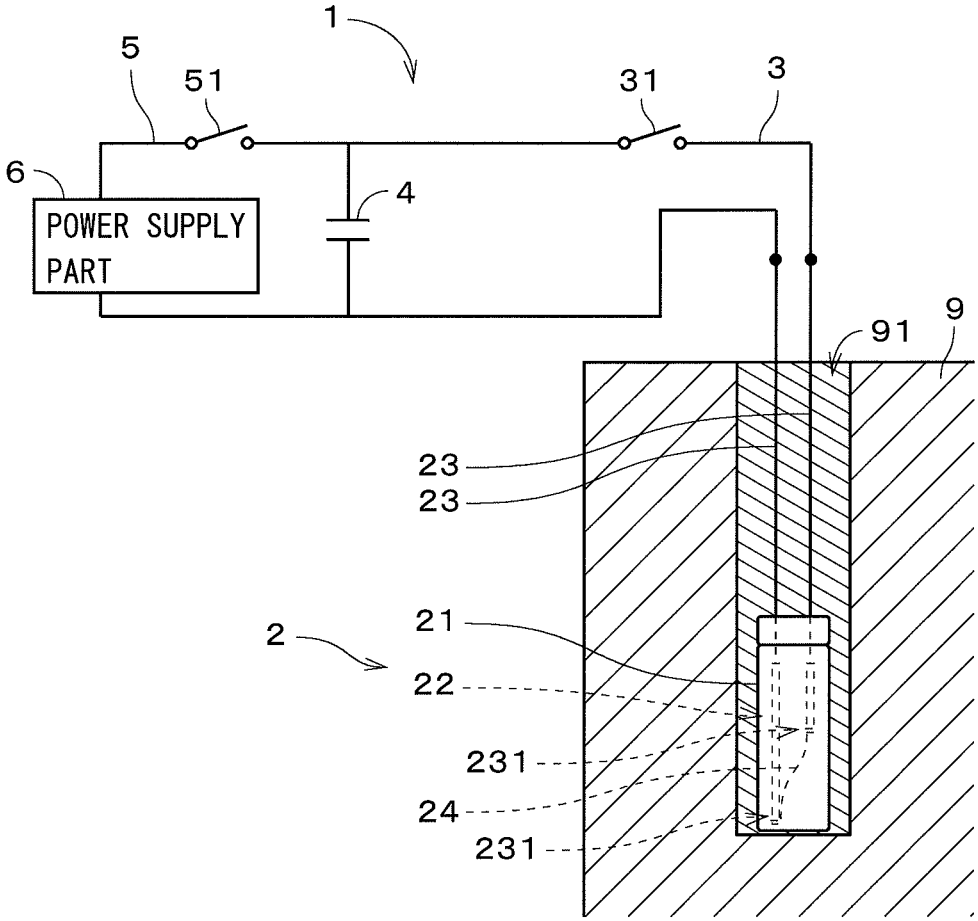
FIG. 3 shows the structure of an electric discharge impact blasting apparatus.

FIG. 3 shows an electric discharge impact blasting apparatus 1. The electric discharge impact blasting apparatus 1 includes the cartridge 2, a capacitor 4 connected to the leadwires 23 via wiring 3, a power supply part 6 connected to the capacitor 4 via wiring 5, a discharge switch 31 provided in the wiring 3, and a charging switch 51 provided in the wiring 5. In the electric discharge impact blasting apparatus 1, the capacitor 4, the power supply part 6, the wiring 3, the wiring 5, the discharge switch 31, and the charging switch 51 constitute a power supply device that supplies electric energy to the cartridge 2. The power supply part 6 is a DC power supply, and the capacitor 4 preferably has an electrostatic capacitance greater than or equal to 100 μF and less than or equal to 1000 μF.

Figure 4:
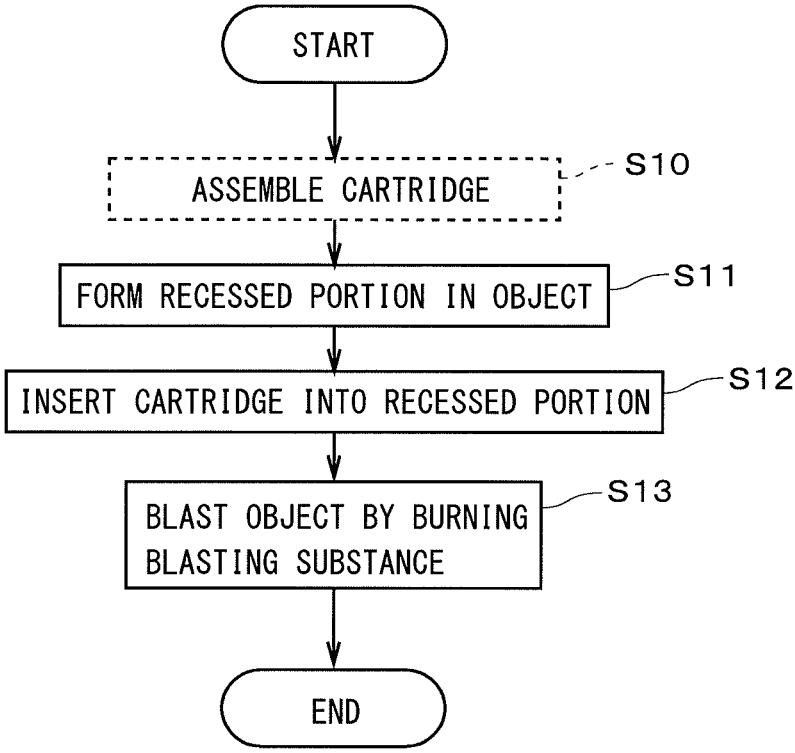
FIG. 4 shows the procedure for blasting an object.

FIG. 4 shows the procedure for blasting an object with the electric discharge impact blasting apparatus 1. Step S10 in FIG. 4 indicates the aforementioned operation of assembling the cartridge 2 performed prior to a blasting operation. For blasting with the electric discharge impact blasting apparatus 1, firstly a recessed portion 91 is formed with a drill or the like in an object 9 as shown in FIG. 3 (step S11). A cross section of the recessed portion 91 that is perpendicular to a depth direction thereof is generally circular in shape. The object 9 is drawn in cross section in FIG. 3 in order to facilitate understanding of the figure.

Next, end portions of the leadwires 23 on the opposite side to the tip portions 231 are connected to the wiring 3 outside the blasting container 21, and the cartridge 2 is inserted in the recessed portion 91 of the object 9 (step S12). In the recessed portion 91, so-called tamping is performed, in which the recessed portion 91 is filled with sand or the like and tamped down firmly from above the cartridge 2. In the electric discharge impact blasting apparatus 1, electric energy is supplied from the power supply part 6 to the capacitor 4 via the wiring 5 by turning the charging switch 51 on with the discharge switch 31 off.

After that, by turning the charging switch 51 off and turning the discharge switch 31 on, the electric energy accumulated in the capacitor 4 is discharged to the thin metal wire 24 through the leadwires 23. Instantaneous high voltage and large current cause the thin metal wire 24 to instantaneously melt and vaporize into a metal gas of several thousand degrees, and subsequent additional supply of electric energy from the capacitor 4 into the metal gas produces plasma.

High temperature and high pressure generated by the melting and vaporization of the thin metal wire 24 and the resultant plasma cause the burning reaction of the blasting substance 22 to start in the vicinity of the plasma, and that burning reaction propagates and spreads through the blasting substance 22 within the blasting container 21. With the electric discharge impact blasting apparatus 1, blasting of the object 9 is caused by an impact force generated by expansion of the blasting substance 22 during burning (i.e., electric discharge impact force) (step S13).

Figure 5:
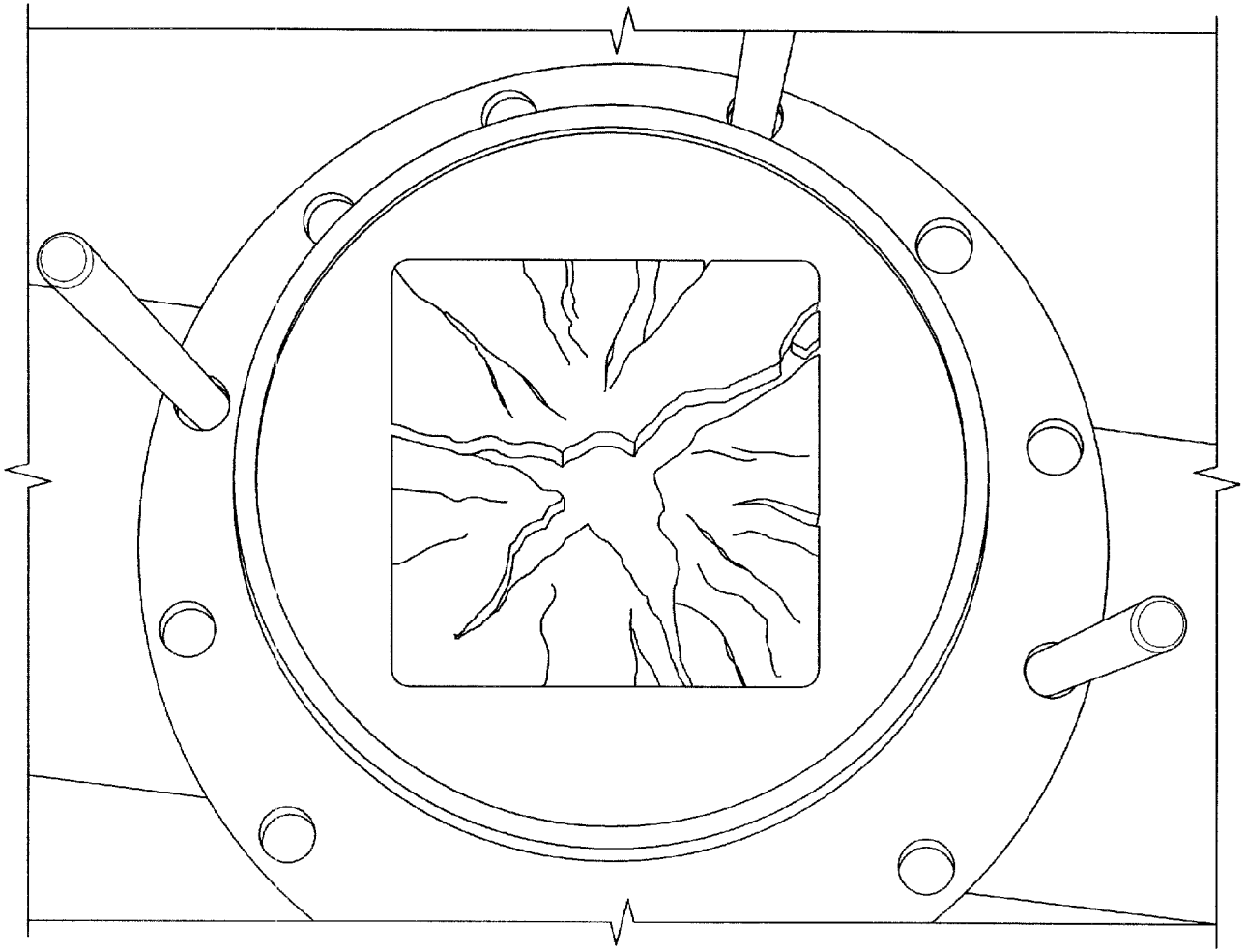
FIG. 5 shows an object that has undergone blasting.
Figure 6:
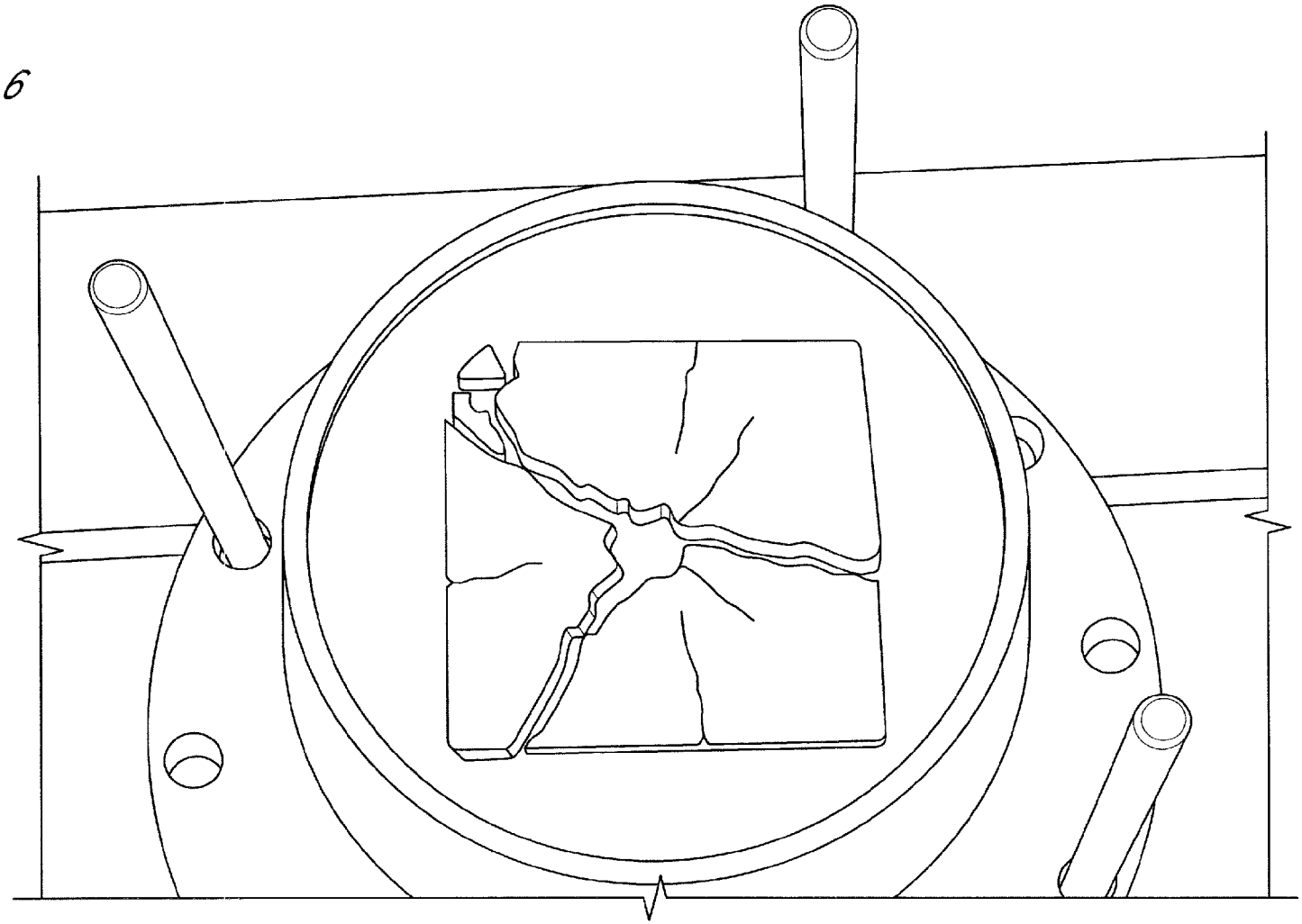
FIG. 6 shows an object that has undergone blasting.

FIG. 5 shows a test concrete object that has undergone blasting by the electric discharge impact blasting apparatus 1. In the electric discharge impact blasting apparatus 1, a discharge voltage of 1500 V is applied to the thin metal wire 24, and a current of 2500 A is caused to flow. FIG. 6 shows a concrete object that has undergone blasting by a blasting apparatus according to a comparative example. In the blasting apparatus according to the comparative example, a copper wire is used as the thin metal wire, and a discharge voltage of 4000 V is applied to the thin metal wire. The other structures and other blasting conditions are the same as those of the electric discharge impact blasting apparatus 1.

Figure 7:
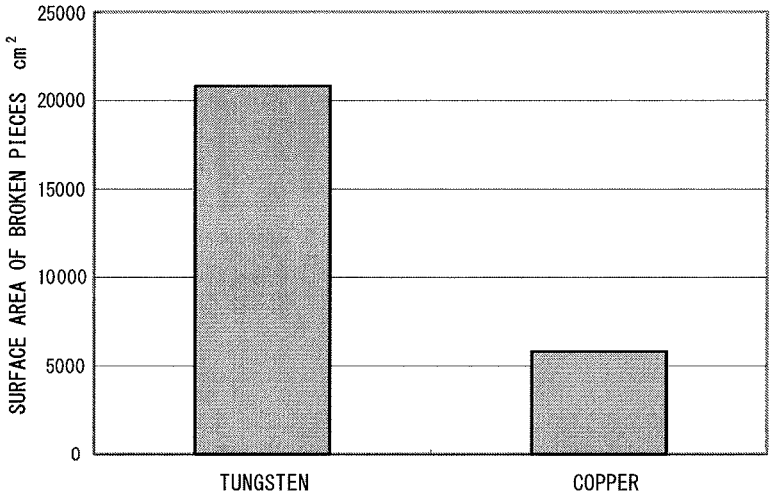
FIG. 7 shows the relationship between two types of thin metal wires and the surface area of broken pieces.

As shown in FIGS. 5 and 6, a concrete object can be broken into smaller pieces with the electric discharge impact blasting apparatus 1. FIG. 7 shows total sums of the surface areas of a large number of broken pieces of the concrete objects shown in FIGS. 5 and 6. In FIG. 7, a large number of broken pieces are divided into a plurality of levels, and for each level, the surface area is obtained by multiplying the surface area per unit weight by the weight of broken pieces. As a result, a sum of the surface areas for the respective levels is calculated as the total sum of the surface areas of the large number of broken pieces.

As shown in FIG. 7, the total sum of the surface areas of broken pieces generated by blasting with the electric discharge impact blasting apparatus 1 is approximately four times greater than that with the blasting apparatus according to the comparative example. Meanwhile, tungsten has a resistivity of 5 (123 at 3000 K) μΩ·cm and an evaporation point of 5828K, whereas copper has a resistivity of 1.55 μΩ·cm and an evaporation point of 2840K. That is, the thin metal wire 24 of tungsten has a higher resistance than a copper wire (i.e., a high heating value) and vaporizes at higher temperatures. For this reason, even with a discharge voltage of 1500 V, the electric discharge impact blasting apparatus 1 generates a greater impact force than the blasting apparatus of the comparative example where the discharge voltage is 4000 V.

Figure 8:
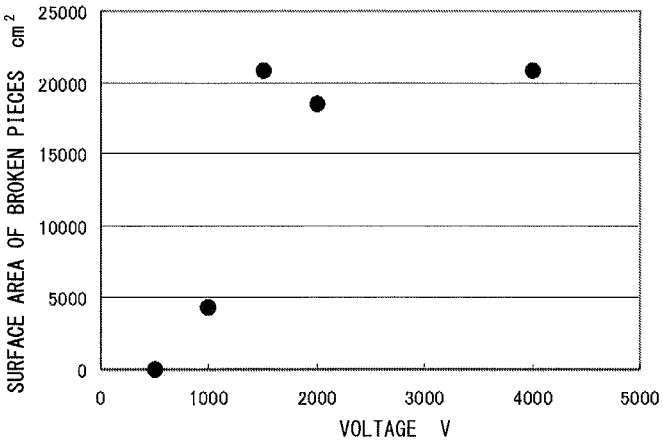
FIG. 8 shows the relationship between the discharge voltage and the surface area of broken pieces.

FIG. 8 shows the relationship between a plurality of discharge voltages in the electric discharge impact blasting apparatus 1 and the total sum of the surface areas of broken pieces. As shown in FIG. 8, it can be seen that as the discharge voltage increases from 0 V to 1500 V, the surface area of broken pieces increases and the impact force increases rapidly. The surface area of broken pieces is substantially constant in the range in which the discharge voltage is 1500 V or higher. This indicates that the discharge voltage of 1500 V or higher enables the blasting substance 22 to give a sufficient impact force.

As described above, with the electric discharge impact blasting apparatus 1, a great impact force is ensured even at lower voltages greater than or equal to 1500 V and less than or equal to 3000 V (more preferably, a voltage greater than or equal to 1500 V and less than or equal to 2000 V, which is usually not used with a copper wire), as compared with a discharge voltage of a conventional blasting apparatus using a copper wire, which exceeds 3000 V. Reducing the discharge voltage increases the degree of freedom in selecting the constituent elements of the electric discharge impact blasting apparatus 1, such as the capacitor 4, and enables a reduction in the cost of the electric discharge impact blasting apparatus 1. In terms of the cartridge 2, the assembly of the cartridge 2 is easy because the thin metal wire 24 is fixed to the leadwires 23 by crimping with the crimping sleeves 232. Furthermore, the reliability of blasting can be improved because the crimping sleeves 232 are not broken until the thin metal wire 24 melts and vaporizes.

The length of the thin metal wire 24 is preferably greater than or equal to 10 mm and less than or equal to 120 mm, and more preferably, greater than or equal to 20 mm and less than or equal to 80 mm. The cross-sectional diameter of the thin metal wire 24 is preferably greater than or equal to 0.2 mm and less than or equal to 0.4 mm (i.e., the cross-sectional area is greater than or equal to 0.03 $mm^2$ and less than or equal to 0.13 $mm^2$). This ensures rigidity without excessively thickening the thin metal wire 24. As a result, the handling of the thin metal wire 24 is easy as compared with a copper wire that has substantially the same length and the same cross-sectional area.

Furthermore, it is also possible to melt and vaporize the thin metal wire 24 with reliability by setting the length and the diameter of the thin metal wire 24 within the above ranges and applying a sufficient current to the thin metal wire 24 while maintaining the discharge voltage greater than or equal to 1500 V and less than or equal to 3000 V.

In the cartridge 2, a plurality of (preferably, two or three) stranded thin metal wires may be used instead of a single thin metal wire 24. In this case, the length of each of the thin metal wires and the sum of the cross-sectional areas of these thin metal wires are set to be within the same range as in the case of using a single thin metal wire 24.

While the above has been a description of embodiments of the present invention, the present invention is not intended to be limited to the above-described embodiment, and various modifications are possible. For example, the blasting substance 22 is not limited to either nitromethane or liquid as long as it is a self-reactive substance. For example, alcohols containing nitromethane or a mixture of ammonium nitrate and alcohol or oils may be used as the blasting substance.

Furthermore, the above-described blasting method does not necessarily have to use the blasting container 21. In the case where the blasting container 21 is not used, a step of directly housing the blasting substance 22 in the recessed portion 91 formed in the object 9, a step of positioning the thin metal wire 24, both ends of which are connected to the leadwires 23, within the blasting substance 22 within the recessed portion 91, and a step of sealing the recessed portion 91 are performed in order specified, instead of step S12.

In the above-described embodiments, the recessed portion formed in the object 9 may be shaped like a groove. The above-described electric discharge impact blasting apparatus 1 is particularly suitable for, for example, a finishing-blasting operation performed in a tunnel, an operation of demolishing a concrete structure, a blasting operation performed under water, and other blasting or demolition operations in which shot-firing operations are limited.

While the invention has been shown and described in detail, the foregoing description is in all aspects illustrative and not restrictive. It is therefore understood that numerous modifications and variations can be devised without departing from the scope of the invention.

REFERENCE SIGNS LIST

1 Electric discharge impact blasting apparatus
2 Cartridge
3 Wiring
4 Capacitor
6 Power supply part
9 Object
21 Blasting container
22 Blasting substance
23 Leadwires
24 Thin metal wire
31 Discharge switch
91 Recessed portion
S10-S13 Step

The invention claimed is:

1. A blasting cartridge to be used in a blasting apparatus that blasts an object, comprising: a single self-reactive blasting substance consisting essentially of nitromethane;

a container that contains said blasting substance;

a tungsten wire disposed within said blasting substance, said tungsten wire having a length greater than or equal to 10 mm and less than or equal to 120 mm and a cross-sectional area greater than or equal to 0.03 $mm^2$ and less than or equal to 0.13 $mm^2$, said tungsten wire being configured to reach the evaporation temperature of tungsten by application of an applied voltage which is greater than or equal to 1500 V and less than or equal to 3000 V to thereby detonate said nitromethane; and a pair of leadwires whose one ends are connected to both ends of said tungsten wire and whose other ends are connected to a power supply device outside said container.

2. The blasting cartridge according to claim 1, wherein, said tungsten wire is formed of a single metal wire or two or three stranded metal wires.

3. A blasting apparatus for blasting an object, comprising: a blasting cartridge as defined in claim 1; and said power supply device, wherein said power supply device comprises: a capacitor connected to said pair of leadwires; a power supply part that supplies electric energy to said capacitor; and a discharge switch that discharges electric energy accumulated in said capacitor to said tungsten wire as said applied voltage through said pair of leadwires.

4. The blasting apparatus according to claim 3, wherein, said tungsten wire is formed of a single metal wire or two or three stranded metal wires.

5. The blasting apparatus according to claim 3, wherein said capacitor has an electrostatic capacitance greater than or equal to 100 μF and less than or equal to 1000 μF.

6. A blasting method for blasting an object, comprising the steps of:

a) housing a blasting cartridge comprising self-reactive blasting substance, a tungsten wire and a pair of leadwires as defined in claim 1, in a recessed portion formed in an object, such that said tungsten wire whose both ends are connected to said pair of leadwires is positioned within said blasting substance; and b) causing said tungsten wire to melt and vaporize by supplying said applied voltage to said pair of leadwires and thereby blasting said object by an impact force caused by said blasting substance.

7. The blasting method according to claim 6, wherein, said tungsten wire is formed of a single metal wire or two or three stranded metal wires.

8. The blasting method according to claim 6, wherein said capacitor has an electrostatic capacitance greater than or equal to 100 μF and less than or equal to 1000 μF.

* * * * *